United States Patent [19]

Horowitz et al.

[11] 4,398,847

[45] Aug. 16, 1983

[54] CLAMPING DEVICE

[75] Inventors: Alexandre Horowitz, Eindhoven; Henricus P. Willemsen, Aarle Rixtel, both of Netherlands

[73] Assignee: Varitrac AG, Zug, Switzerland

[21] Appl. No.: 267,997

[22] Filed: May 28, 1981

[30] Foreign Application Priority Data

May 30, 1980 [NL] Netherlands ..... 8003185

[51] Int. Cl.[3] ..... E02B 17/08

[52] U.S. Cl. ..... 405/199; 254/105

[58] Field of Search ..... 405/196, 198, 199; 254/105, 107; 24/249 R; 285/382.7

[56] References Cited

U.S. PATENT DOCUMENTS

| | | | |
|---|---|---|---|
| 3,570,032 | 3/1971 | Allen | 405/199 X |
| 3,684,322 | 8/1972 | Kotsakis | 285/382.7 X |
| 3,685,801 | 8/1972 | Ahlgren et al. | 254/105 |
| 3,763,654 | 10/1973 | Matsushita | 254/105 X |

*Primary Examiner*—James A. Leppink
*Assistant Examiner*—Beverly E. Hjorth
*Attorney, Agent, or Firm*—Laurence R. Brown

[57] ABSTRACT

Clamping device having clamping members cooperating via a pressure area and an intermediate member with a pressure member, the intermediate member consisting of a slide member having a cross section in the form of a segment of a circle, a plane surface cooperating with the pressure area and a circular arc-shaped surface in a corresponding seating provided in the associated clamping or pressure member.

15 Claims, 11 Drawing Figures

CLAMPING DEVICE

BACKGROUND OF THE INVENTION

1. Field of the Invention

The present invention relates to a clamping device comprising at least two clamping members which are provided with teeth on the gripping face while each of which, via a pressure area disposed at an angle with respect to the gripping face, cooperates with a pressure member capable of exerting a clamping force directed toward the gripping face.

2. Description of the Prior Art

This type of clamping device is known from U.S. Pat. No. 3,570,032; in this known device the intermediate members consist of two rings of balls spaced from one another. The drawback of this arrangement is that, due to inevitable deformations of the part which is clamped by the clamping members and which may be for example a support post of a platform, only an unpredictable portion of all of the teeth is in engagement and can break through corrosion spots if any, which results in too strong forces being exerted on this limited number of teeth. Consequently, in practice a large number of teeth is used on each clamping member, which then must be small and cannot break through a corrosion layer and individually take up a high load. As a result, this known clamping arrangement has turned out to be insufficiently reliable in practice.

SUMMARY OF THE INVENTION

The object of the invention is to eliminate this drawback, and to this end, according to the invention, each intermediate member is comprised of a slide member having a cross section in the form of a segment of a circle whose plane surface cooperates with the pressure area, and whose circular arc-shaped surface is positioned in a corresponding seat provided in the associated clamping or pressure member.

By using such a slide member, the clamping members are capable of adjustment with respect to the part to be gripped, for example a support post, as a result of which proper adaption to the surface thereof is obtained. This affords the use of a limited number of teeth per clamping shoe. When exerting pressure on the clamping members, all teeth will engage and will be able to break through corrosion spots, as the force per tooth will be sufficiently great. The occurrent forces can be calculated beforehand, thus preventing the teeth from being exposed to extra wear and tear and avoiding the occurrence of tooth ruptures.

The angle formed between a face perpendicular to the gripping face and a face perpendicular to the pressure area preferably varies from 15° to 30°; this ensures that, after pushing the parts in place and applying the load on the pressure member, the whole is self-locking.

In addition, it will be preferable to use teeth having a vertical angle of 60°–90°.

In order to obtain the best possible effect, the friction forces between the slide members and the pressure and clamping members cooperating therewith must be small. Therefore according to the invention the slide members are preferably made of a material having a relatively low coefficient of friction with respect to steel and preferably consist of a sintered material having a solid lubricant such as graphite introduced in the pores.

The advantageous low friction forces can also be obtained by covering the respective contact areas of the members with suchlike material.

According to the invention the slide members may be made in several ways.

In one method a bar-shaped element having a cross-section identical with that of a finished slide member is provided with evenly spaced recesses and is subsequently bent, according to a full or partial circumference of a circle having a suitable diameter, in a direction perpendicular to the straight sliding faces.

In a preferred embodiment of the invention, a pair of two interspaced clamping members always cooperate with one pressure member having, on the side facing the clamping members, two pressure faces jointly forming an obtuse angle and converging in the direction of the gripping faces.

Before the pressure member is able to resist a load, it is, of course, necessary to bring about a certain amount of pretension, which can be realized by using external hydraulic pistons. In an advantageous form of embodiment, however, each pressure member is provided with one or several bores formed therein and wherein there is slidingly and sealingly disposed a piston element coupled by way of a piston rod to a clamping member, the chambers on both sides of the piston communicating with pressure medium connections through ducts formed in the pressure member.

According to two other advantageous embodiments, likewise having first and second clamping members cooperating with one pressure member, the pretension may be brought about by means of a bolt which cooperates with the first and second clamping members and which can be turned in one of the clamping members from the outside of the clamping arrangement, in which case, in a first embodiment with pressure areas diverging towards the gripping faces, the clamping members can be pushed away from one another and against the pressure areas, and, in a second embodiment with pressure areas converging toward the gripping faces, the clamping members can be pushed toward one another and against the respective pressure areas. These forms of embodiment are particularly useful if permanent pretension is desired and when it is undesirable or impossible to use hydraulic devices.

Such a situation arises for example when anchoring under water an island platform support post to piles driven into the bottom, with cupped spring washers being provided between the bolt and clamping shoe if need be.

According to the prior art such a support post is anchored by coupling the post to a ring of cylindrical cases, each having a diameter of approx. 2 m and a length of 20 m, through which anchoring piles are driven having a length of for instance 40–60 m. Thereupon, using special sealing means (for example the SR Piling Seal) the space in each cylindrical case between the case and the pile is sealed off and filled with concrete, at least at a certain level. This method of anchoring is particularly time-consuming and expensive, in addition to being permanent; removing the platform is only possible by burning through the posts under water. When using the clamping arrangement according to the invention, one clamp is or two clamps are fastened within a case; after having driven in the piles, the bolts are tightened (which, when using two clamping arrangements, is possible by disposing the lower one in a manner so that the bolts are accessible via the spaces provided between the segments of the upper one) while using simple tools which are also operable at a great depth by means of a manipulator.

The arrangement according to the invention is particularly adapted to be used on a lifting device for stepwise vertical displacement of a platform along one or several support posts, the arrangement consisting of at least two clamping arrangements to be actuated individually and interconnected by hydraulic cylinders and one of the two clamping arrangements cooperating with each other always being connected to the platform.

Such a lifting device, and more generally a displacement device, is not restricted to clampingly engaging with the same support post by means of the two cooperating clamping arrangements. In addition, it can be used not only for vertical displacement but for displacements in any direction as well.

The clamping members preferably have the shape of a ring segment and are enclosed by a single annular pressure member. However, it is also possible to have an embodiment with two straight opposed clamping members, each cooperating with one of two opposed straight pressure members interconnected with one another.

The invention and the advantages thereof will be more readily appreciated and understood by reference to the following detailed description considered in connection with the accompanying drawings.

DESCRIPTION OF THE PREFERRED EMBODIMENTS

Figure 1:
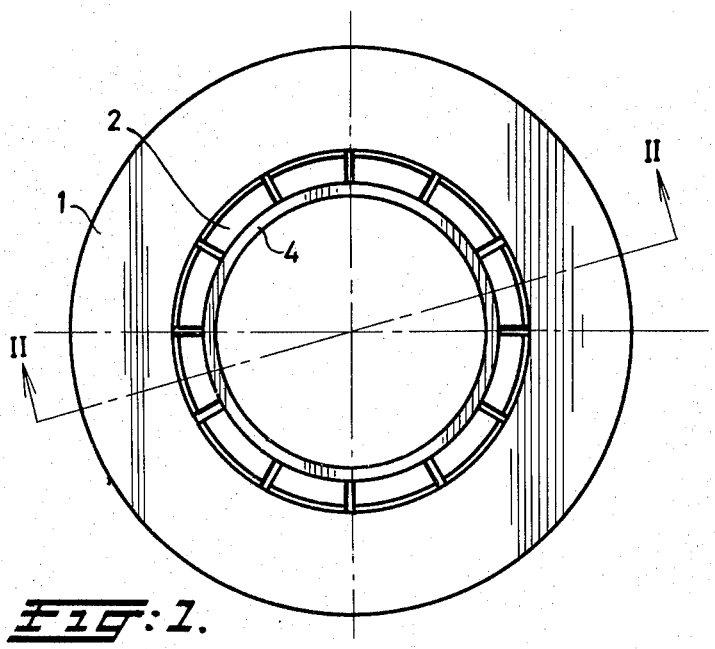
FIG. 1 is a top view of a clamping arrangement of the invention embracing a support post.
Figure 2:
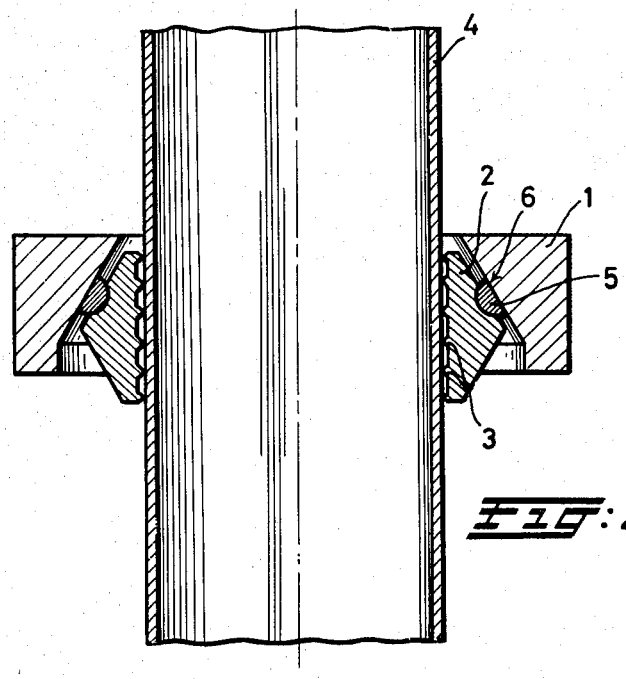
FIG. 2 is a cross-sectional view of the clamping arrangement of FIG. 1 taken along line II—II.

The FIGS. 1 and 2 are top and cross-sectional views respectively of a clamping arrangement according to the invention having an annular pressure member 1 preferably in the form of a single piece, a number of clamping members 2 engaging the support post 4 with their toothings 3. Between the pressure member 1 and each clamping member 2 there is provided a slide member 5 whose cross section is in the form of a segment of a circle and whose plane surface cooperates with the pressure area 6 of the pressure member 1, and whose arcuate surface is positioned in a corresponding seat provided in the associated clamping member 2. Depending on the degree of penetration of the teeth 3 through the corrosion layer and into the outer surface of the post 4, the clamping member 2 will adjust itself via the slide member 5.

The pressure member 1 may be connected to a platform, not shown, in such a manner that, after locking the post 4 to the platform by means of, for example, a second clamping arrangement, the first clamping arrangement can be displaced along the post 4. After eliminating the locked condition, the load of the pressure member 1 causes, due to the wedge-like disposition of the clamping member 2 in the pressure member 1, the clamping member 2 to engage with the outer wall of the post 4. By alternatingly actuating the clamping arrangements it is possible to displace the post step by step with respect to the platform as known in itself.

Since the slide members 5 afford a slight tilting of the clamping members 2 within the pressure member 1, the position of each clamping member 2 adjusts to deformations, if any, of the post 4, thus ensuring full engagement of all teeth 3 with the post.

The clamping arrangement according to the FIGS. 1 and 2 is single acting and capable of accepting a unidirectional load on which means that the arrangement can transfer the load onto the post 4 only when the pressure member 1 is stressed in one particular direction and that, in a condition of non-engagemet of the teeth 3 with the post 4 and in general in the absence of the said load, the clmaping arrangement is displaceable along the post 4.

Figure 3:
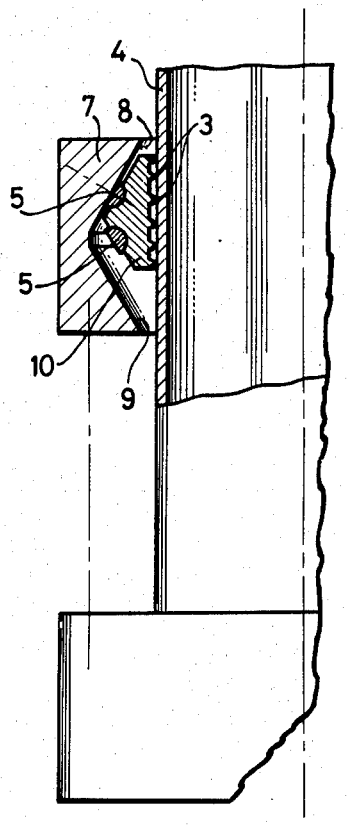
FIG. 3 is a partial cross-sectional view of a clamping arrangement which is double acting and capable of accepting a unidirectional load.
Figure 4:
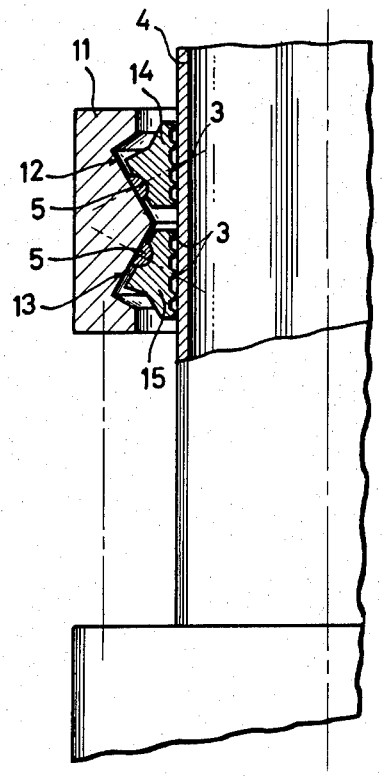
FIG. 4 is a partial cross-sectional view of a clamping arrangement which is double acting and capable of accepting a bidirectional load.

The clamping arrangements according to the invention shown in the FIGS. 3 and 4 are double acting, which means that they can be used for bidirectional vertical loads.

To this end the clamping arrangement as per FIG. 3 is formed with a pressure member 7 whose section show a substantially triangular recess with the open end facing the post 4 and whose other sides form the pressure areas 8 and 9. Via slide blocks 5 they cooperate with a clamping member 10 having a triangular section and toothing 3.

In addition to being double acting, the clamping arrangement as per FIG. 4 can also accept a bidirectional load so that, as a result, in the event of the load being reversed the clamping arrangement will not move along the post 4.

The clamping arrangement according to FIG. 4 consists of a pressure member 11 provided with pressure areas 12 and 13 along which toothed clamping members 14 and 15 respectively can be moved by way of slide blocks 5; the pressure areas enclose an obtuse angle between the clamping members.

Before transferring the load onto the pressure member 1, 7, 11, the clamping members 2, 10, 14, 15 are to be pressed, by means of a pressure mechanism, against the post 4 with a force reduced with respect to the load so as to prevent the clamping arrangement from being displaced when actually applying the load.

A pressure means of this type can be included in all clamping arrangements described hereinbefore, but will be explained with reference to FIG. 5 only for a double acting clamping arrangement capable of accepting a load on two sides as per FIG. 4.

Figure 5:
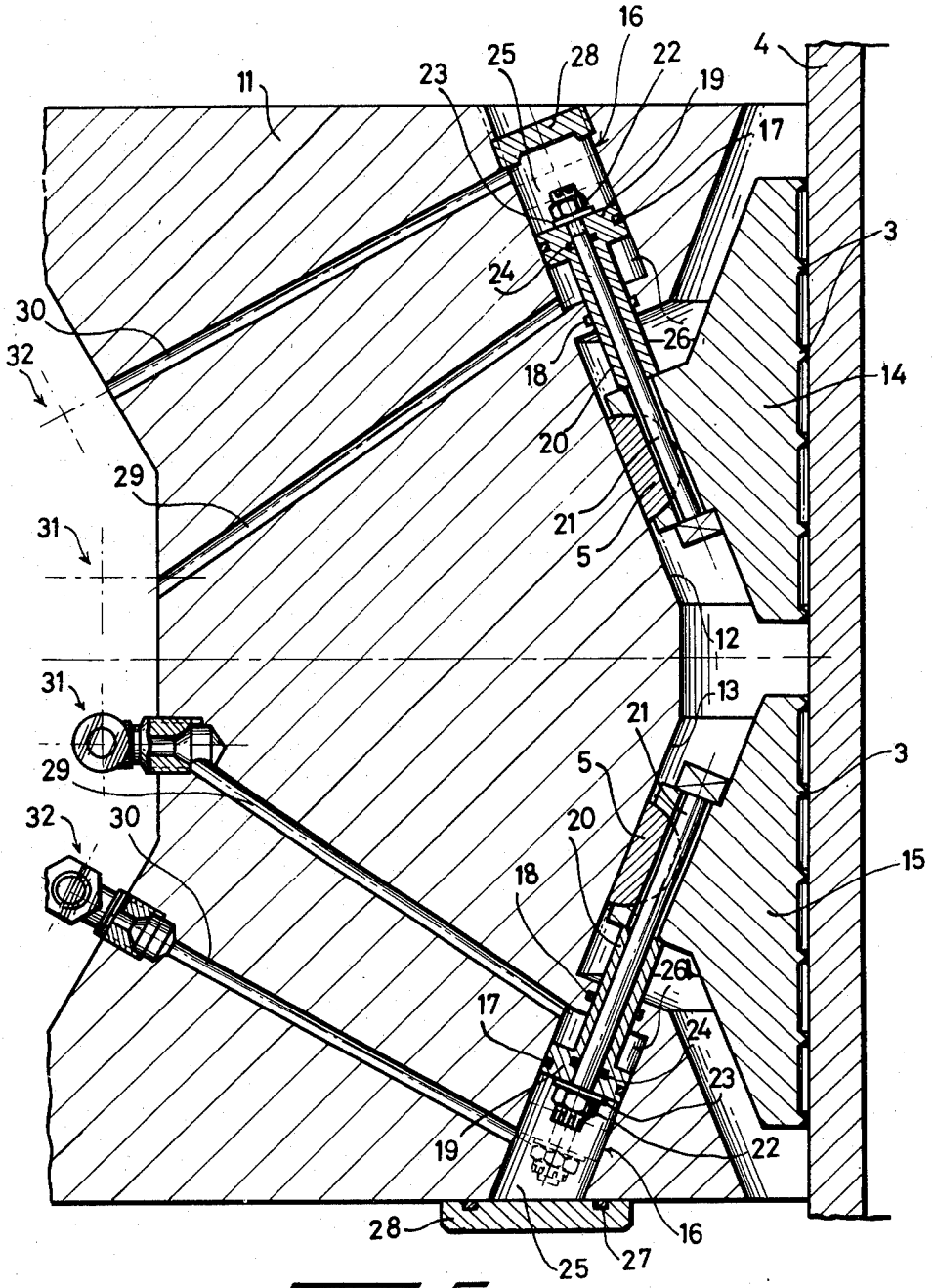
FIG. 5 is a partial cross-sectional view of a double acting clamping arrangement capable of accepting a bidirectional load, the clamping member accommodating pressure means for the pressure members.

The pressure member 11 of the clamping arrangement according to FIG. 5 is provided with bores 16 into which fits a piston element 19 with sealing rings 17 and 18 and a piston rod 20, the piston element 19 and the piston rod 20 being connected to the clamping members 14, 15 by means of a bolt 21 in a bore as per the center line of the piston element 19, the piston rod 20 in a bore in clamping member 14, 15 in a plane parallel to the pressure area 12, 13 and by a nut 22 provided on the bolt 21 with washer 23. The nut 22 preferably is a castle nut and, as the bolt 21 will have some clearance in at least one of the bores into which it fits so as to afford the clamping members 14, 15 some tilting via the slide members 5, the bolt 21 in the piston element 19 may be enclosed by a sealing 24, so that the medium in the piston chamber 25 of the bore 16 cannot leak away. The chamber 25, into which the bolt 21 extends, is closed off with a closing piece which may be disposed over as well as within the bore 16 and which is schematically indicated in FIG. 5, only by a cover plate 28 provided with a sealing 27. The piston chambers 25 and 26 on both sides of the piston 19 are connected with pressure-medium connections 31 and 32 by way of ducts 29 and 30 respectively, formed in the pressure member 11.

Depending on the function to be performed by the clamping arrangement, a pressure medium can be supplied to or discharged from a piston chamber 25 or 26 via a connection 31 or 32 and the duct 29 or 30 connected therewith, as a result of which the clamping member 14 or 15 moves away from the wall of the post 4 or is pressed against it.

Figure 6:
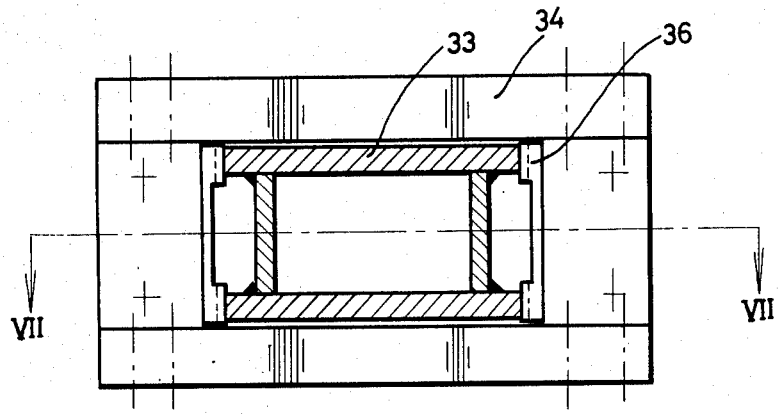
FIG. 6 is a top view of a clamping arrangement to be used in cooperating with a substantially rectangular support post.
Figure 7:
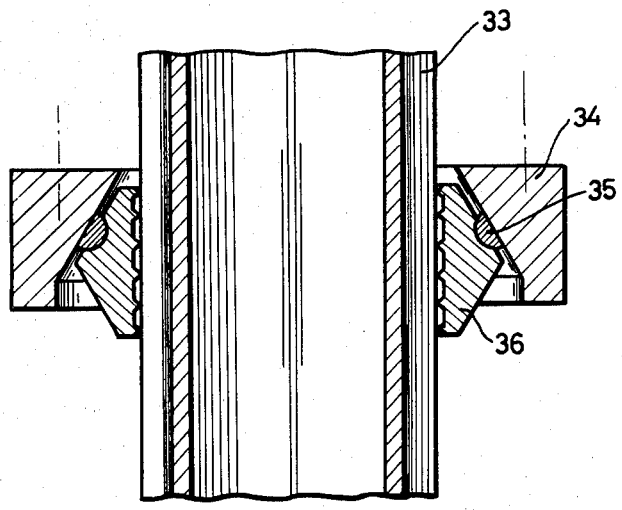
FIG. 7 is a cross-sectional view of the clamping arrangement of FIG. 6 taken along line VII—VII.

FIGS. 6 and 7 show the top view and a section taken along line VII—VII in FIG. 6, respectively, of a clamping arrangement used on a substantially rectangular pole 33, and formed with a closed pressure member 34 which encloses the post 33 and wherein there are disposed straight slide members 35 and toothed clamping members 36. The functional design and the use of the members 34, 35 and 36 correspond to those in the comparable members previously shown. Since the slide members in this embodiment can rotate around two parallel axes, it is possible to obtain a rotation over a greater angle than that in the embodiments according to the preceding figures.

Figure 8:
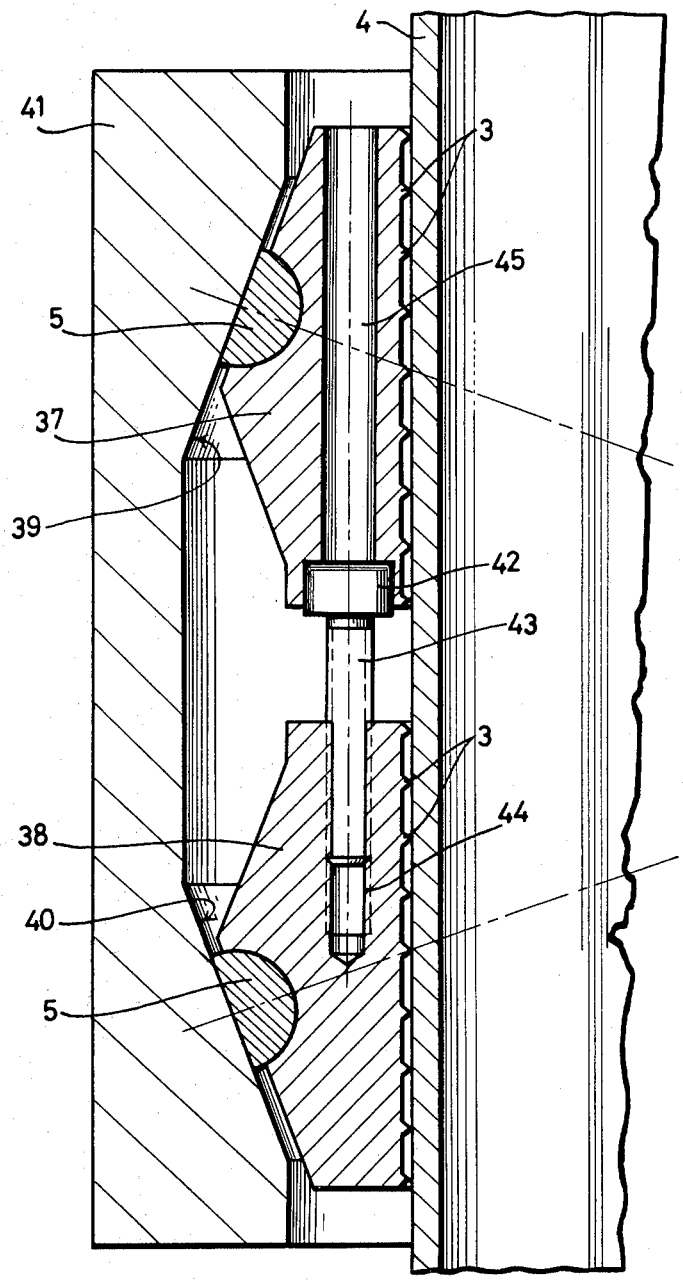
FIG. 8 is a partial cross-sectional view of a clamping arrangement which is double acting and capable of accepting a bidirectional load in which case pretension is imparted to a pair of clamping members by means of a bolt.

FIG. 8 is a partial cross-sectional view of a clamping device which is double acting and capable of accepting a bidirectional load and in which a bolt can prestress pairs of cooperating clamping members. This clamping device comprises a pair of clamping members having a first clamping member 37 and a second clamping member 38 which are both provided with teeth 3 engaging the post 4 and which, by way of slide blocks 5, may be disposed along pressure faces 39 and 40 of a joint pressure member 41, the pressure faces enclosing an obtuse angle and diverging in the direction of the support port 4. On the side facing the second clamping member 38, the first clamping member 37 is provided with a recess in which the head 42 of a bolt 43 can rotate, while the other end of the bolt is screwed into a threaded bore 44 in the clamping member 38, the bolt 43 being turnable from outside the clamping device via a bore 45 provided in the clamping member 37, in cooperating with a non-circular recess in the bolt head 42, using a suitable tool such as a pin wrench.

By turning the bolt 43 so that it moves out of the bore 44 the two clamping members 37 and 38 move away from one another and are pressed against the pressure areas 39 and 40, thus producing a prestressing of the two clampingmembers 37 and 38 against the post 4. The convergence of the pressure areas 39 and 40 affords a certain adjustability of the clamping arrangement with respect to the post 4.

Figure 9:
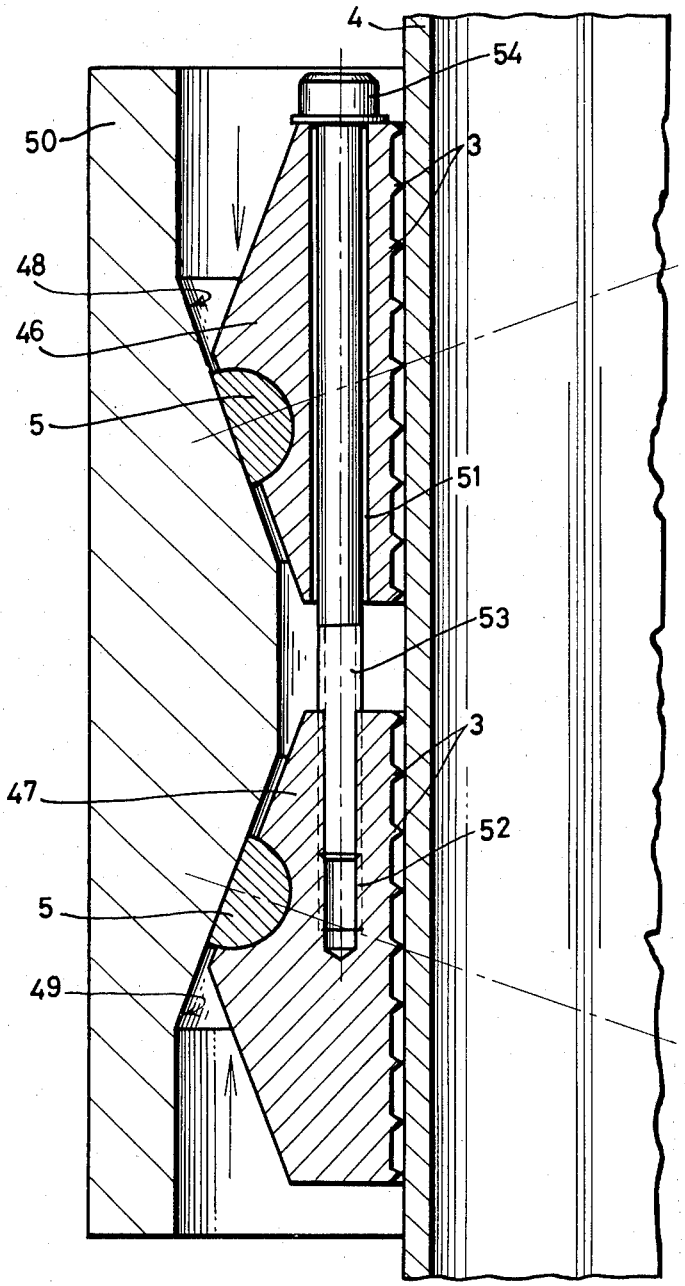
FIG. 9 is a partial cross-sectional view of another clamping arrangement which is double acting and capable of accepting a bidirectional load, in which case pretension can be imparted to a pair of clamping members by means of a bolt.

FIG. 9 is a partial cross-sectional view of a clamping device similar to FIG. 8, but provided with pressure areas which converge in the direction of the post 4. This device consists of a pair of clamping members 46 and 47 which bear with their teeth 3 against the support post 4 and can be displaced via slide blocks 5 along the pressure areas 48 and 49 of the pressure member 50. Both clamping members 46 and 47 are each provided with bores 51 and 52 respectively located in each other's extension, at least a portion of the bore 52 being threaded, in which case, through the bore 51, a bolt 53 may be screwed into the threaded end of the bore 52 and the head 54 of the bolt 53 rests over the bore 51 upon the clamping member 46 and is accessible from outside the clamping arrangement so as to enable turning of the bolt 53.

By turning the bolt 53 into the clamping member 47, the clamping members 46 and 47 are caused to move towards each other and be pressed against the pressure areas 48 and 49 respectively, so that there is obtained a prestressing of the clamping members 46 and 47 against the post 4.

Figure 10:
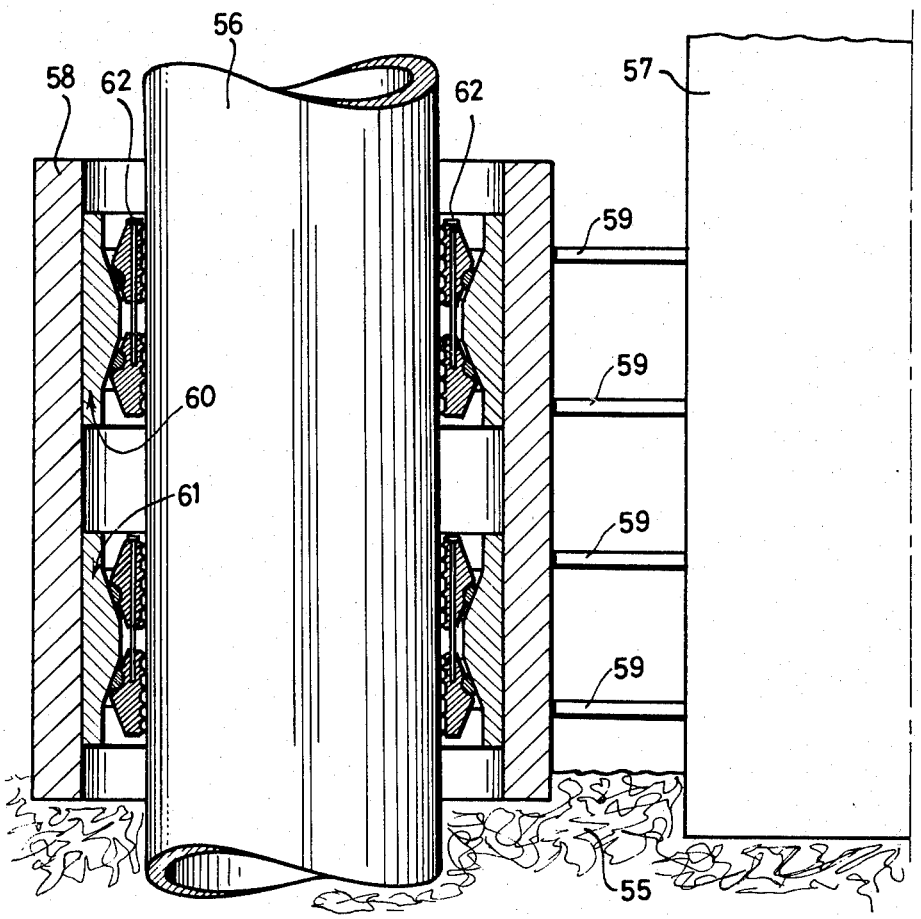
FIG. 10 is a partial cross-sectional view of an anchoring arrangemet for a support post of an island plastform using in particular a clamping arrangement with pretension bolts.

FIG. 10 is a partial cross-sectional view of an anchoring device for a support post of in particular an island platform, wherein a supporting structure connected with the support post is clamped to piles driven into the bottom, using clamping devices according to the invention and in particular with pretension bolts as in the FIGS. 8 and 9.

The figure shows a pile 56 driven into the bottom 55, a number of which are grouped in a circle about a support post 57 of an island platform, not shown. Each pile 56 is surrounded by a case 58 fastened to the support post 57 by means of known fastenings 59. Inside each case 58 there is disposed at least one clamping device, preferably that of the FIGS. 8 and 9. In the embodiment as per FIG. 10 two such clamping devices 60 and 61 are used, the clamping bolts 62 (43 or 53 in FIGS. 8 and 9 respectively) of the lower clamping device 61 being turnable by way of passages in the upper clamping arrangement 60 when using an appropriate tool.

The embodiment with the cases 58 and fastenings 59 may be amended as desired; for example, the structure may be carried out with an articulating means for the support post 57.

By using clamping devices according to FIGS. 8 or 9, and using simple tools, the clamping devices 60 and 61 can be easily clamped about the pile 56 with a certain amount of prestresses, also at a great depth by using for example a deep sea manipulating device. If the anchoring arrangement is to be moved, the clamping devices 60 and 61 can also be easily released from the piles 56 in a reversed manner, so that, with the exception of the piles 56 only, the anchoring arrangement can be re-used elsewhere.

Figure 11:
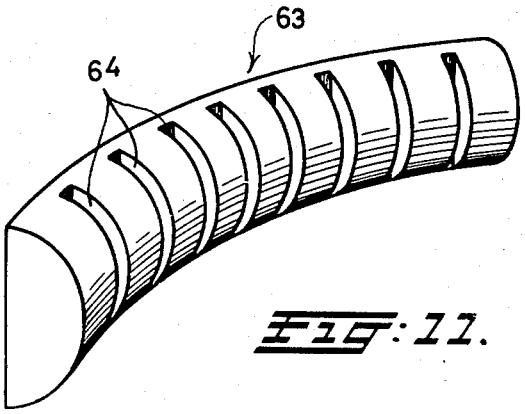
FIG. 11 is a perspective view of a bent or cast bar-shaped element provided with saw cuts and comprising a slide member of a clamping arrangement according to the invention.

FIG. 11 is a perspective view of a bent or cast bar-shaped element 63, which, after making a number of saw cuts 61 and after bending the bar, forms one of the slide members for a clamping device according to the invention. The arc length of the element 63 and the number of slide members provided with saw cuts 64 may, of course, be modified as desired.

Although the saw cuts 64 have been provided in the round side of the element 63, they may also be provided in the flat side, whereas in addition the element 63 may also be bent in the other direction transversely to the flat side.

An advantage of such slide elements or slide members 63 is that they are easier to manufacture; casting entirely annular or partly annular slide members as well as manufacturing slide members from a rough mold and with surface treatments are less simple and also for this reason more expensive.

By fitting two clamping devices about a support post 4 or 33 or pile 56 and interconnecting the pressure members thereof by means of hydraulic cylinders, a clamping jack is obtained which, by selective actuation, i.e. pressing of the clamping members against the post, makes it possible to move, with respect to the post, a load, which is connected to the pressure member of one of the clamping devices, step by step along the post. Of course, the reverse is possible as well, in which case the clamping jack is stationary and drives a pole, which is thus stepwise being displaced, into a load.

Although the present invention has been shown and described in connection with a preferred embodiment thereof, it will be apparent to those skilled in the art many variations and modifications may be made without departing from the invention in its broader aspects. It is therefore intended to have the appended claims cover all such variations and modifications as fall within the true spirit and scope of the invention.

What is claimed is:

1. Clamping device comprising at least two clamping members which are provided with teeth on the gripping faces and each of which, via a pressure area placed at an angle with respect to the gripping face and an intermediate member abutting the former, cooperates with a pressure member capable of exerting a clamping force directed toward the gripping face, the intermediate member consisting of a slide member having a cross section in the form of a segment of a circle whose plane surface cooperates with the pressure area, and whose circular arc-shaped surface is positioned in a corresponding seating provided in the associated clamping or pressure member.

2. Clamping device according to claim 1, in which the angle between a face perpendicular to the gripping face and a face perpendicular to the pressure area is 15°–30°.

3. Clamping device according to claim 1, in which the apex angle of the teeth is 60°–90°.

4. Clamping device according to claim 1, in which the slide members are made of material with a low coefficient of friction, relative to steel.

5. Clamping device according to claim 1, in which the slide members are made of a sintered material whose pores are filled with a solid lubricant.

6. Clamping device according to claim 5, in which the lubricant is graphite.

7. Clamping device according to claim 1, in which the slide members are formed by a bent, basically bar-shaped element provided with a number of recesses.

8. Clamping device according to claim 1, in which a pair of two interspaced clamping members cooperate with one pressure member having, on the side facing the clamping members, two pressure faces including an obtuse angle.

9. Clamping device according to claim 8, in which each pressure member is provided with one or several bores formed therein, and containing a selected piston element coupled through a piston rod to a clamping member, the chambers on both sides of the piston communicating with pressure-medium connections through ducts formed in the pressure member.

10. Clamping device according to claim 8 with pressure areas diverging toward the gripping faces, and comprising a bolt cooperating with the clamping members, said bolt having a head provided with a non-circular recess, while the threaded end of the bolt on the side facing the first clamping member can be screwed into the second clamping member, the bolt head resting against the first clamping member and the recess in said head being accessible from outside the arrangement with a pin tool for turning the bolt via a bore provided in the first clamping member.

11. Clamping device according to claim 1, having pressure areas converging toward the gripping faces and a bolt which cooperates with both clamping members and which, via a bore in the first clamping member and with the head resting upon the first clamping member, can be screwed into the second clamping member from outside the device.

12. Clamping device according to claim 1, comprising a number of clamping members having the shape of a ring segment and being enclosed by a single annular pressure member.

13. Clamping device according to claim 1, comprising two straight opposed clamping members, each cooperating with one of two opposed straight pressure members interconnected with one another.

14. Lifting device for the stepwise displacement of a load along one or several supports, comprising two intercoupled clamping devices, each with at least two clamping members which are provided with teeth on the gripping faces and each of which, via a pressure area placed at an angle with respect to the gripping face and an intermediate member abutting the former, cooperates with a pressure member capable of exerting a clamping force directed toward the gripping face, the intermediate member consisting of a slide member having a cross section in the form of a segment of a circle whose plane surface cooperates with the pressure area and whose circular arc-shaped surface is positioned in a corresponding seating provided in the associated clamping or pressure member.

15. Anchoring device for anchoring a support post connected to a supporting structure, in particular on island platform to a number of piles driven into the bottom, comprising a number of clamping devices, each, with at least two clamping members which are provided with teeth on the gripping faces and each of which, via a pressure area placed at an angle with respect to the gripping face and an intermediate member abutting the former, cooperating with a pressure member capable of exerting a clamping force directed toward the gripping face, the intermediate member consisting of a slide member having a cross section in the form of a segment of a circle whose plane surface cooperates with the pressure area, and whose circular arc-shaped surface is positioned in a corresponding seating provided in the associated clamping or pressure member, while in each clamping device a pair of two interspaced clamping members cooperate with one pressure member having, on the side facing the clamping members, two pressure faces including an obtuse angle.

* * * * *